United States Patent [19]

Crombie, III

[11] 4,401,480

[45] Aug. 30, 1983

[54] METHOD OF SELECTIVE GRAIN GROWTH IN NICKEL-BASE SUPERALLOYS BY CONTROLLED BORON DIFFUSION

[75] Inventor: Edwin A. Crombie, III, West Chester, Pa.

[73] Assignee: Westinghouse Electric Corp., Pittsburgh, Pa.

[21] Appl. No.: 312,574

[22] Filed: Oct. 19, 1981

Related U.S. Application Data

[63] Continuation of Ser. No. 970,047, Dec. 15, 1978, abandoned.

[51] Int. Cl.[3] ..... C22F 1/10

[52] U.S. Cl. ..... 148/11.5 N; 148/13.1; 148/20.3; 148/39

[58] Field of Search ..... 148/13, 13.1, 20.3, 148/11.5 N, 39

[56] References Cited

U.S. PATENT DOCUMENTS 3,741,821 6/1973 Athey et al. ..... 148/13.1

*Primary Examiner*—R. Dean

*Attorney, Agent, or Firm*—Richard A. Stoltz; John J. Prizzi

[57] ABSTRACT

This is a method for producing a composite grain structure in nickel-base superalloy articles by causing a controlled amount of grain growth in selected regions. The method uses alloys containing 0.01–1.0 carbon and 0.02–0.08 boron and a heat treatment in a non-reducing atmosphere after the alloy has been formed. The heat treatment causes diffusion of boron (but not carbon) in selected regions, lowering the amount of boron and causing controlled grain growth in these regions.

9 Claims, No Drawings

METHOD OF SELECTIVE GRAIN GROWTH IN NICKEL-BASE SUPERALLOYS BY CONTROLLED BORON DIFFUSION

This is a continuation of application Ser. No. 970,047, filed Dec. 15, 1978, now abandoned.

BACKGROUND OF THE INVENTION

The present invention relates to nickel-based alloys having relatively great strength at high temperature and generally referred to (e.g. U.S. Pat. Re No. 28,681 issued to Baldwin on Jan. 13, 1976) as superalloys, and, in particular, to articles with different grain sizes in different portions of the article.

The literature shows that, for nickel-based superalloy systems, grain size has a definite effect on mechanical properties. In general, increasing grain size has the effect of increasing high temperature creep rupture properties. The effect of increasing grain size decreases the total grain boundary area and thereby reduces the propensity of grain boundary failure mchanisms to occur.

Conversely, decreasing grain size enhances such properties as high cycle fatigue due to the increased fracture energy required to propagate cracks by enabling the increased grain boundary area to retard dislocation movement. In addition, such properties as impact strength are enhanced by decreasing grain size.

Grain size control in superalloys is generally considered critical in the manufacture of most turbine hardware. Difficulties, however, are routinely experienced by forging, casting and powder forming processes insofar as grain size and uniformity are concerned. The literature shows that increased carbon additions to nickel-based alloys generally aid grain size control in forged products.

Complex cooling schemes and insulated molds designed to control cooling rates of cast alloys have been employed for grain size control. Powder metallurgical component structures are generally restricted by the initial particle size. A dual grain structure for improved properties is described in U.S. Pat. No. 3,741,821 issued June 26, 1973 to Athey et al., but requires complex equipment, extremely close temperature control, and two separate heat treatments. A mechanical process for providing fine surface grains and coarse internal grains is described in U.S. Pat. No. 3,505,130, issued to Paul on Apr. 7, 1970. It requires special surface cold working and a recrystallization heat treatment. Such cold working is impractical on some alloys because of the susceptibility to cold work cracking and, further, the results of such mechanical working can be lost to relaxation at turbine operating temperatures. Thornburg's U.S. Pat. No. 3,597,286 issued Aug. 3, 1971 uses annealed cold rolled iron-cobalt-vanadium alloy and produces a partially recrystallized grain structure with a balance of room temperature mechanical properties commensurate with magnetic characteristics. Such a recrystallization process is generally difficult with age hardenable nickel base compositions and can also result in relaxation at high operating temperatures.

Boron is known to (up to certain amounts, where incipient melting occurs at operating temperature) improve stress rupture properties (see 4,093,476 issued to Boesch). It also acts as a grain boundary ductilizer (see the aforementioned Re No. 28,681).

U.S. Pat. No. 2,763,584, issued to Badger on Sept. 18, 1956 employs decarbonization and deboronization of exterior surfaces of articles for the purpose improving thermal shock resistance. Heating in a hydrogen atmosphere presents problems and is expensive, and the removal of carbon results in loss of control on grain size.

SUMMARY OF THE INVENTION

This is a method for producing a composite grain structure in nickel-based superalloy articles. The size of the grains is varied in a controlled manner (both the size of enlarged grains and location of the enlarged grains is controlled).

This method comprises preparing a nickel-based superalloy containing, by weight percent, 0.01–0.10 carbon and 0.02–0.08 boron, forming this alloy into a configuration approximating the final configuration, and heating the formed alloy in a non-reducing atmosphere to a temperature of 1800°–2500° F. (but less than the homogenization temperature) for 1–10 hours. Diffusion of boron from portions of the article which are exposed (without masking) to the atmosphere allows grain growth selectively in these exposed portions of the article. The non-reducing atmosphere generally maintains the carbon content constant. Thus, the diffusion of boron of the exposed surfaces into the atmosphere allows grain growth in those regions of the alloy, but the carbon content is maintained to provide an effective upper limit to grain growth.

Preferably, unmasked passages are provided into the interior of the article and the outside surfaces of the article are masked. This provides for grain growth only in the interior of the article adjacent to the passages and thus a composite structure with larger grains in the interior and smaller grains on the exterior of the article.

DESCRIPTION OF THE PREFERRED EMBODIMENTS

If the carbon content of the nickel-based superalloy is reduced, without replacing the carbon with boron, grain coarsening during solution heat treatment will result. If boron is substituted for the carbon, however, a fine grain structure can be maintained. Apparently, the grain boundary pinning by carbon provides grain size control during solution heat treatment but this control can also be provided by boron. The boron, however, can diffuse during solution heat treatment, resulting in deboronization of exposed metal surfaces. By maintaining the carbon level, and controlling which regions are exposed, controlled grain growth in selective regions can be achieved.

The usefulness of such a system is exemplified by rotating turbine blade hardware. Extensive efforts are being made to increase rupture strength capability of such hardware.

For rotating turbine blades, increased grain size would normally increase creep rupture strength, but, with all the grains increased in size, this would result in decreased fatigue resistance. Thus, with such effectively homogeneous grain sizes, properties are currently compromised. The controlled deboronization of this invention, however, can provide for turbine blades which utilize large internal grains for creep strength and fine surface grain structure for maximum resistance to high cycle fatigue initiation.

A special alloy was prepared using a version of the Udimet-710 composition generally described in U.S. Pat. No. 3,667,938 issued to Boesch, modified to have low carbon (0.024% versus the normal 0.08%) and higher boron (0.05% versus the normal 0.01%). After forging, the grain structure was extremely fine and uniform. After solution heat treatment (2135° F. for 4 hours in air) the grains exposed to the furnace atmosphere grew substantially in comparison to the unexposed grain structure, providing a composite structure having an extremely uniform bond of enlarged grains, both of uniform band thickness and uniform grain size.

As noted previously, the optimum turbine blade design should have large internal grains and fine external grains. This can be achieved by machining cooling passages (cooling passages are commonly used in the turbine blades) prior to solution heat treatment and coating the external surfaces with oxide or glass coatings to generally prevent diffusion of boron out of the external surfaces. Thus, during solution heat treatment, the cooling passages are exposed to the furnace environment and the external surfaces are masked. This process rovides a structure having fine, fatigue-resistant grains on the exterior surfaces and other regions remote from the cooling passages together with enlarged, creep-resistant grains in regions adjacent to the cooling passages.

This same structure with large internal grains and fine external grains can alternately be achieved without the oxide or glass coatings by fabricating an oversized forging with cooling passages, heat treating, and then machining the surface. Thus, large grains are formed both in regions adjacent to the cooling passages and on the external surface during solution heat treatment, but the large grains on the external surfaces are removed during machining to provide a fine grain external surface.

This composite grain structure technology is not limited to forged structures, but can also be expanded to other structures such as cast or powder metallurgy and hot pressing structures. Cast or powder products may need additional hot working to increase stored strain energy for recrystallization and growth, and thus it may be convenient to use powder and cast structures as forging preforms. Heat treatment in a non-reducing atmosphere provides deboronization without decarburization and thus provides control of the amount of grain growth and the location of grain growth in these types of structures as well.

It should be noted that no significant further deboronization (after solution heat treatment) will occur during service (e.g. during the operation of the turbine) as maximum service temperatures are not sufficiently high for significant diffusion of boron. While a variety of compositions can be used, this invention can be conveniently practiced by modifying a known alloy by substituting (approximately an equal atom percentage) boron for a portion of the carbon in the commercially available composition. Preferably between 25 and 75 atom percent of the carbon in the known composition is replaced with boron.

Generally the solution heat treatment is performed at a temperature between 2100° F. and 2500° F. and the alloy is held at that temperature for 2–4 hours. The atmosphere during the treatment can be either inert (e.g. argon) or oxidizing (e.g. air).

Thus, it can be seen that grain size control by a deboronization process of carbon, nickel-base superalloys can be utilized to produce a composite grain structure with enlarged grain structures of controlled maximum size in specific regions to attain significantly improved hardware creep rupture life and simultaneously fine grain, high cycle fatigue-resistant regions. This is attained by a single heat treatment procedure and this procedure may be employed with forged, cast, or powder metallurgical thermal treatment cycles.

As variations additional to the above can be made without varying the inventive concept described herein, the invention should not be construed as limited to the particular forms described, as these described forms are to be regarded as illustrative rather than restrictive. The invention is intended to cover all forms which should not depart from the spirit and scope of the invention.

I claim:

1. A method of producing a composite grain structure in nickel-base superalloy articles, said method comprising:

(a) preparing a nickel-base superalloy containing, by weight percent, 0.01–0.10 carbon and 0.02–0.08 boron;

(b) forming said alloy into a configuration approximating the final configuration;

(c) heating said article to a temperature of 1,800° to 2,500° F. and holding said article at said temperature for 1 to 10 hours; and (d) diffusing boron into a nonreducing atmosphere from only selected portions of said hot article by exposing only said selected portions to said nonreducing atmosphere to allow grain growth in said selected portions while maintaining carbon content to provide an effective limit to grain growth.

2. The method of claim 1, wherein said nickel-base superalloy is prepared by modifying a known nickel-base superalloy composition by substituting a substantially equal atom percentage of boron for a portion of the carbon, said substitution being for between 25 and 75 atom percent of the carbon in the known composition.

3. The method of claim 1, wherein said formed nickel-base superalloy is subjected to a single heat treatment during which said alloy is held at a temperature of between 2100° and 2,500° F. for 2–5 hours.

4. A method of producing a composite grain structure in nickel-base superalloy articles, said method comprising:

(a) preparing a nickel-base superalloy containing, by weight percent, 0.01–0.10 carbon and 0.02–0.08 boron;

(b) forming said alloy into a configuration approximating the final configuration;

(c) masking selected areas of said article to minimize the diffusion of boron into a nonreducing atmosphere from said masked areas; and (d) diffusing boron into said nonreducing atmosphere from unmasked portions of said alloy by exposing said unmasked portions to said nonreducing atmosphere at a temperature of 1800°–2500° F. for 1–10 hours to allow grain growth while maintaining carbon content to provide an effective vapor limit to grain growth.

5. The method of claim 4, wherein unmasked passages are provided into the interior of said article and the outside surfaces of said article are masked, whereby grain growth will selectively occur in the interior of said article.

6. The method according to claim 2 wherein said known nickel-base superalloy is a Udimet-710 composition.

7. A turbine blade made in accordance with the method of claim 1.

8. A turbine blade made in accordance with the method of claim 4.

9. A turbine blade made in accordance with the method of claim 5.

* * * * *